US011682372B2

(12) United States Patent
Fukuda et al.

(10) Patent No.: US 11,682,372 B2
(45) Date of Patent: Jun. 20, 2023

(54) EFFECTOR MOUNTING PLATE

(71) Applicant: Roland Corporation, Shizuoka (JP)

(72) Inventors: Yasuhiro Fukuda, Shizuoka (JP); Norihiko Wada, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/558,520

(22) Filed: Dec. 21, 2021

(65) Prior Publication Data

US 2022/0208161 A1 Jun. 30, 2022

(30) Foreign Application Priority Data

Dec. 24, 2020 (JP) ..... 2020-215750

(51) Int. Cl.
*G10H 1/34* (2006.01)

(52) U.S. Cl.
CPC ..... *G10H 1/348* (2013.01); *G10H 2230/371* (2013.01)

(58) Field of Classification Search
CPC ..... G10H 1/348
See application file for complete search history.

(56) References Cited

U.S. PATENT DOCUMENTS 4,029,327 A * 6/1977 Kolstein ..... B60B 33/0002 280/47.131
5,866,829 A * 2/1999 Pecoraro ..... G10H 3/186 84/177
6,164,425 A * 12/2000 Latshaw ..... A45C 5/14 206/315.3
6,215,055 B1 * 4/2001 Saravis ..... G10H 1/348 84/746
6,459,023 B1 * 10/2002 Chandler ..... G10H 1/32 84/180
6,538,185 B1 * 3/2003 Stratton ..... G10H 1/348 84/444
6,723,909 B1 * 4/2004 Hooper, II ..... G10H 1/32 84/177
8,614,385 B2 * 12/2013 McKinney ..... G10H 1/348 84/453
D781,954 S * 3/2017 Wilfer ..... D17/20
9,620,094 B2 * 4/2017 Abbate ..... F16M 13/02
9,659,553 B1 * 5/2017 Lawrence ..... G10H 1/348
D815,682 S * 4/2018 Trifilio ..... D17/20
D820,904 S * 6/2018 Fiden ..... D17/99
10,163,430 B2 * 12/2018 Jashyn ..... G10H 1/348
D862,578 S * 10/2019 Lackner ..... D17/20
(Continued)

*Primary Examiner* — Robert W Horn
(74) *Attorney, Agent, or Firm* — JCIPRNET

(57) ABSTRACT

An effector mounting plate is provided, which can protect wiring when carried while enabling work on the wiring. A back surface side of a plate is covered by a back case, and wiring (not shown) can be stored in a space formed between the plate and the back case. Therefore, when the plate and the back case are used as an effect pedal or carried, an external force can be prevented from acting on the wiring. Therefore, the wiring (jack) can be prevented from falling off an effector or from being forcibly bent and broken. By removing fastening screws, the back case can be removed from the plate to open the back surface side of the plate. Therefore, work on the wiring such as work of connecting/disconnecting the wiring to/from the effector and work of checking the wiring before performance can be easily performed.

18 Claims, 10 Drawing Sheets

(56) References Cited

U.S. PATENT DOCUMENTS

| | | | | |
|---|---|---|---|---|
| D862,583 | S * | 10/2019 | Lackner | D17/20 |
| 10,565,971 | B2 * | 2/2020 | Wilfer | G10H 1/34 |
| 10,832,644 | B2 * | 11/2020 | Fiden | G10H 1/348 |
| 11,107,450 | B2 * | 8/2021 | Chickneas | H04H 60/04 |
| 11,417,301 | B2 * | 8/2022 | Stanley | G10G 7/00 |
| 2017/0040008 | A1 * | 2/2017 | Byrne | A45C 13/262 |
| 2019/0279605 | A1 * | 9/2019 | Parker | G10G 7/005 |
| 2020/0294480 | A1 * | 9/2020 | Trifilio | G10H 1/0008 |
| 2022/0208162 | A1 * | 6/2022 | Moriyama | G10H 1/348 |
| 2022/0412691 | A1 * | 12/2022 | Searle | F41C 33/06 |

* cited by examiner

EFFECTOR MOUNTING PLATE

CROSS-REFERENCE TO RELATED APPLICATION

This application claims the priority benefits of Japanese application no. 2020-215750, filed on Dec. 24, 2020. The entirety of the above-mentioned patent application is hereby incorporated by reference herein and made a part of this specification.

BACKGROUND

Technical Field

The disclosure relates to an effector mounting plate, and more particularly relates to an effector mounting plate that can protect wiring when carried while enabling work on the wiring.

Description of Related Art

Pedal boards are known for their capability of mounting multiple effectors (effect devices). For example, Patent Document 1 describes a pedal board, which includes a mounted member having a mounted surface 12 to which an effector is mounted (a member formed by connecting between a first member 30 and a second member 32 with a plurality of transverse members 34), and a support frame 42 protruding from a surface opposite to the mounted surface 12 of the mounted member. When the pedal board is placed on the floor 44, a space is formed between the pedal board and the floor 44 corresponding to the protruding height of the support frame 42.

According to this pedal board, an opening 18 is formed on the mounted surface 12 so wiring of the effector can pass through the opening 18 to the back surface side and be stored in the above space. As a result, it is possible to prevent the wiring from causing a mess on the mounted surface 12. Therefore, the appearance on the mounted surface 12 can be improved, and the wiring can be prevented from becoming an obstacle during performance. Further, work can be easily performed on the wiring by turning the pedal board over.

RELATED ART

Patent Document

[Patent Document 1] Specification of U.S. Pat. No. 6,459,023 (for example, FIG. 7 and FIG. 13)

Here, the pedal board is generally carried with a plurality of effectors mounted and the wiring connected so that a musical instrument can be played immediately after being connected. However, for the conventional pedal board described above, the wiring on the back surface side is exposed so when the pedal board is stored in a case or taken out of the case, an external force may be applied to the wiring and cause the connection with the effectors to be disconnected or the wiring to be bent and broken.

SUMMARY

Problems to be Solved

The disclosure provides an effector mounting plate that can protect the wiring when carried while enabling work on the wiring.

Means for Solving the Problems

An effector mounting plate according to an embodiment of the disclosure includes: a mounted member which is formed with a through hole penetrating between a mounted surface, on which an effector is mounted, and a back surface opposite to the mounted surface; a back surface side member which covers a back surface side of the mounted member and is mounted on the mounted member in a state of forming a space with the back surface of the mounted member; and a first means for enabling work in the space.

An effector mounting plate according to an embodiment of the disclosure includes: a mounted member having a mounted surface on which an effector is mounted; a back surface side member mounted on the mounted member in a state of covering an opposite side of the mounted surface of the mounted member; and a cover member mounted on the back surface side member in a state of covering a mounted surface side of the mounted member.

An effector mounting plate according to an embodiment of the disclosure includes: a mounted member which is formed with a through hole penetrating between a mounted surface, on which an effector is mounted, and a back surface opposite to the mounted surface; a back surface side member which covers an entire back surface side of the mounted member and is detachably mounted on the mounted member in a state of forming a space with the back surface of the mounted member; a cover member which is mounted to engage the back surface side member in a state of covering entirety of the mounted surface on a mounted surface side of the mounted member; wheels which are rotatably mounted on one side of the back surface side member or the cover member; and a handle which is mounted on an other side opposite to the one side of the back surface side member or the cover member.

BRIEF DESCRIPTION OF THE DRAWINGS (a) of FIG. 1 is a front perspective view of the effector case according to an embodiment, and (b) of FIG. 1 is a rear perspective view of the effector case.

FIG. 2 is an exploded front perspective view of the effector case.

(a) of FIG. 3 is a front view of the plate, and (b) of FIG. 3 is a rear view of the plate.

Figure 8:
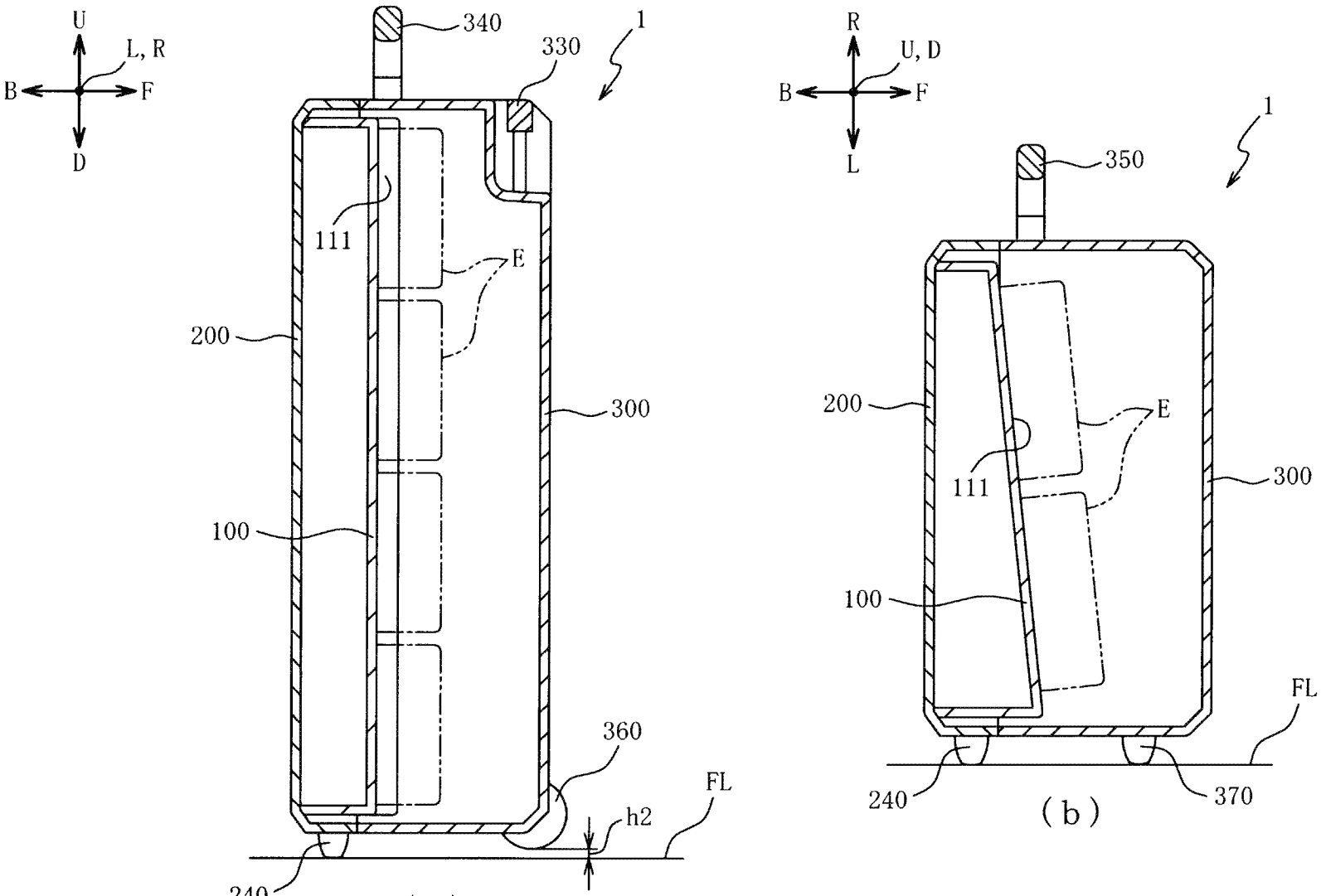

(a) and (b) of FIG. 8 are schematic cross-sectional views of the effector case.

Figure 9:
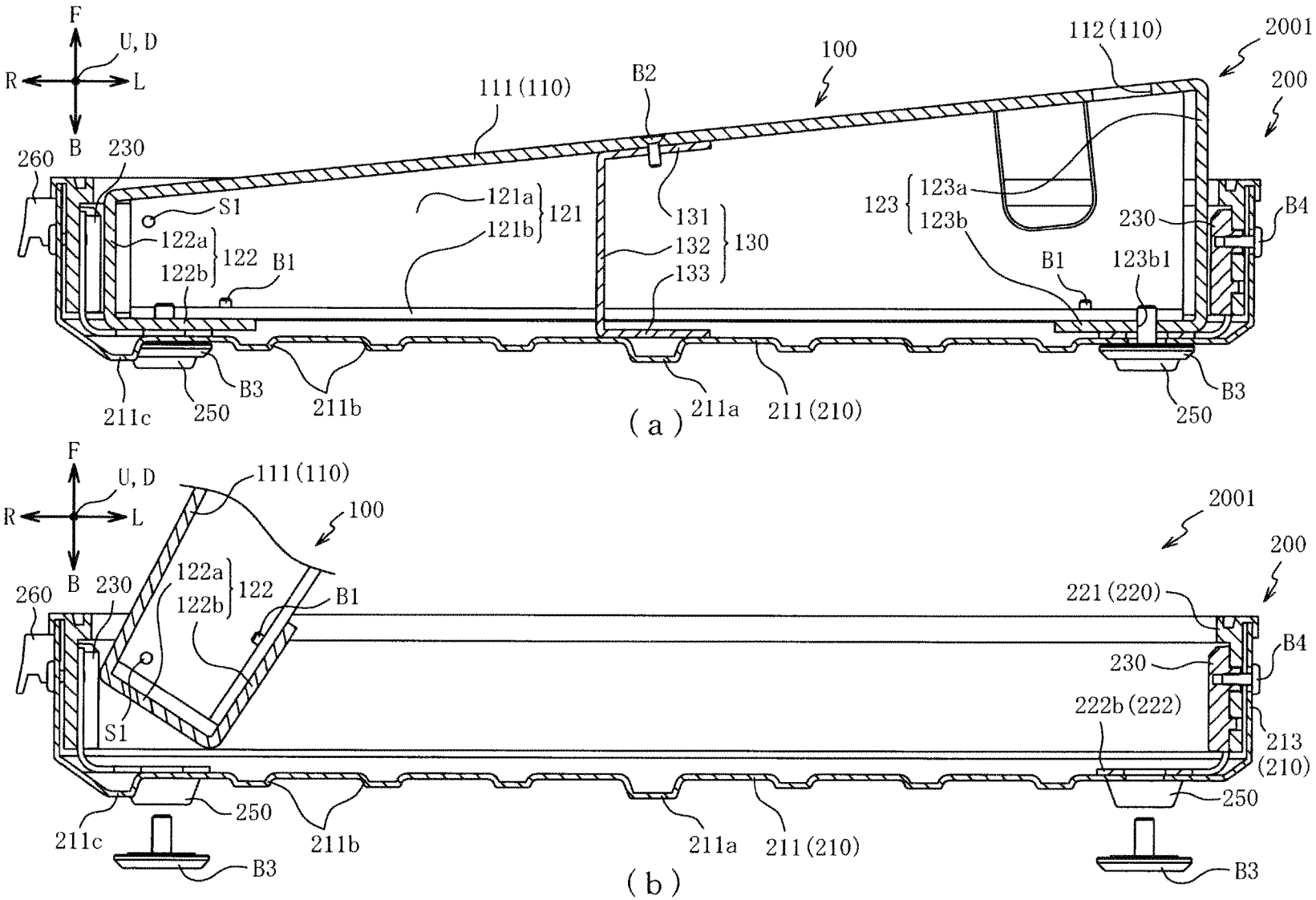

(a) and (b) of FIG. 9 are cross-sectional views of the effector case according to the first modification.

Figure 10:
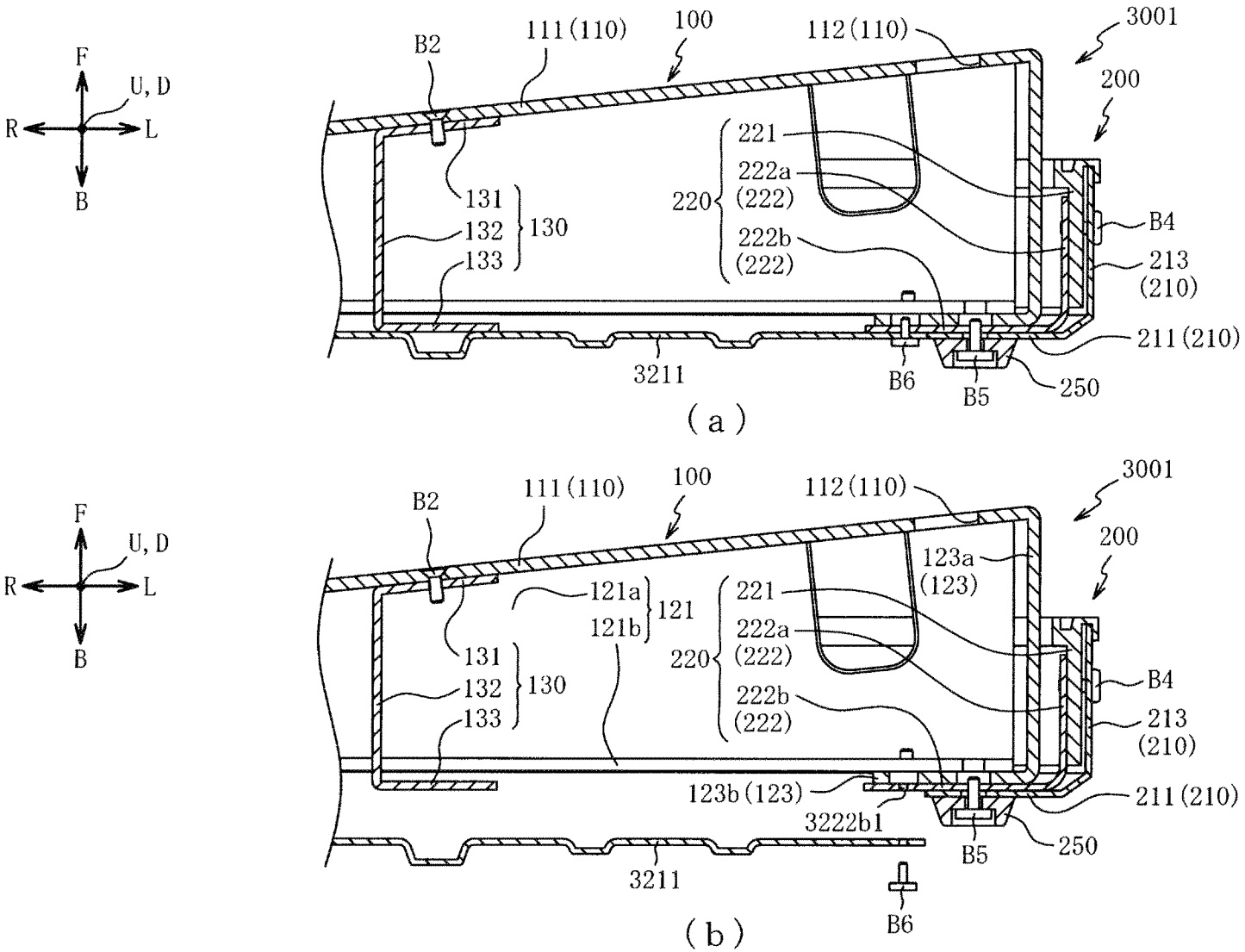

(a) and (b) of FIG. 10 are cross-sectional views of the effector case according to the second modification.

DESCRIPTION OF THE EMBODIMENTS

Figure 1:
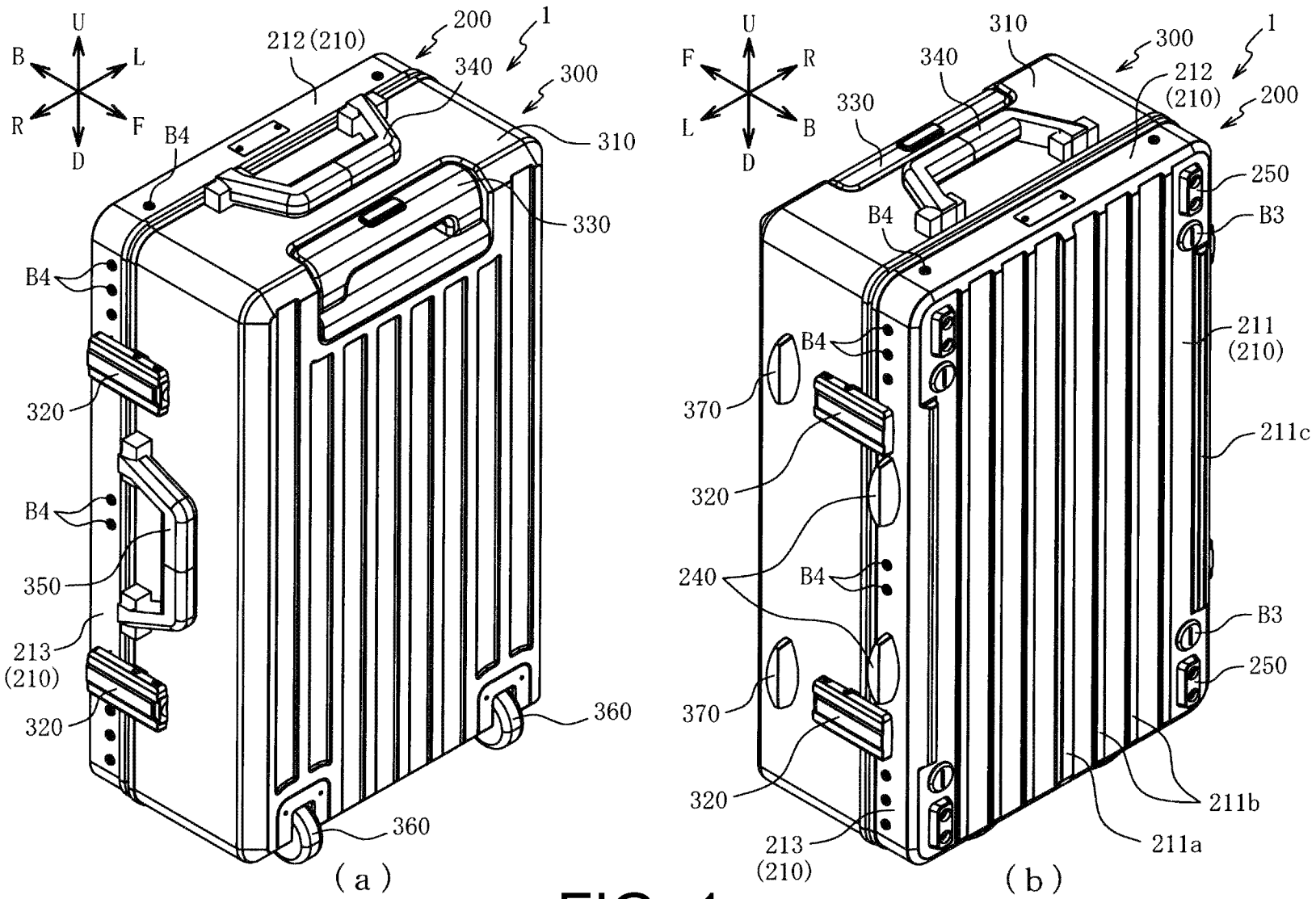
Figure 2:
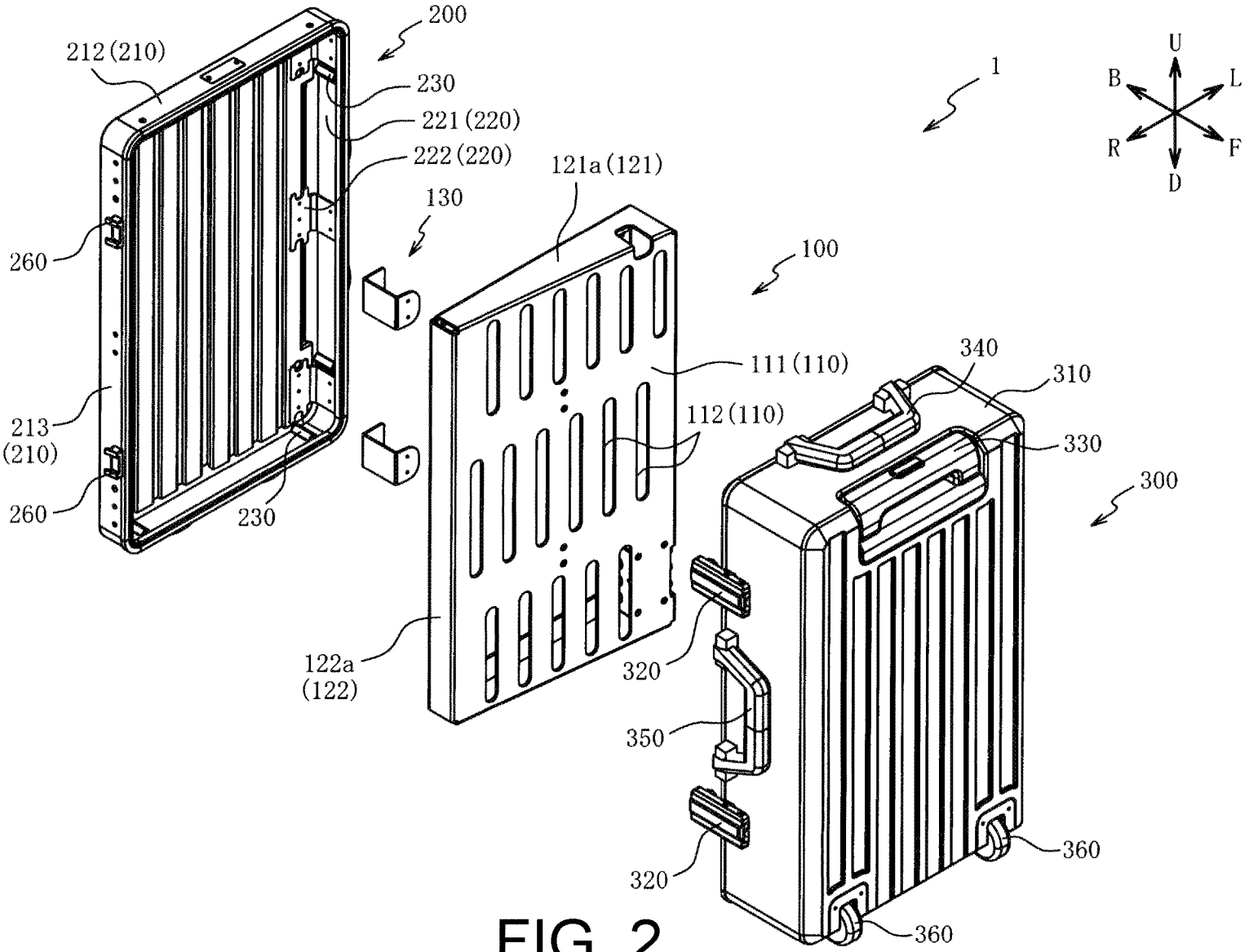

Hereinafter, exemplary embodiments will be described with reference to the accompanying drawings. First, the overall configuration of an effector case 1 will be described with reference to FIG. 1 and FIG. 2. (a) of FIG. 1 is a front perspective view of the effector case 1 according to an embodiment, and (b) of FIG. 1 is a rear perspective view of the effector case 1. FIG. 2 is an exploded front perspective view of the effector case 1.

Surfaces on the sides facing the arrow F direction, the arrow B direction, the arrow U direction, the arrow D direction, the arrow L direction, and the arrow R direction of FIG. 1 and FIG. 2 are defined as the front surface, the back surface, the upper side surface, the lower side surface, the left side surface, and the right side surface of the effector case 1 (plate 100, back case 200, and front case 300). The same applies to FIG. 3 and thereafter.

As shown in FIG. 1 and FIG. 2, the effector case 1 includes a plate 100 having a mounted surface 111 to which an effector (effect device, not shown) is mounted, a back case 200 mounted on the back surface side of the plate 100, and a front case 300 mounted on the front surface side of the back case 200. The effector case 1 is formed in a rectangular parallelepiped shape by the back case 200 and the front case 300.

As will be described later, the effector case 1 can be used as a case that can be carried in a state of storing an effector E by mounting the front case 300 on the back case 200 (see FIG. 8), and the back case 200 and the plate 100 can be used as a pedal board in a state where the front case 300 is removed from the back case 200 (see FIG. 6 and FIG. 7).

The front case 300 includes a case body 310 formed in a box shape with the back surface side of the rectangular parallelepiped opened, fixtures 320 respectively mounted on the left side surface and the right side surface of the case body 310, a telescopic handle 330 stored in a ridge portion between the front surface and the upper side surface of the case body 310, an upper handle 340 and a transverse handle 350 respectively mounted on the upper side surface and the right side surface of the case body 310, wheels 360 rotatably mounted on a ridge portion between the front surface and the lower side surface of the case body 310, and leg members 370 mounted on the right side surface.

The fixture 320 is configured to be operable to a fixed position or a release position, and can be engaged with an engaging metal fitting 260 mounted on the right side surface of the back case 200. By engaging the fixture 320 operated to the fixed position with the engaging metal fitting 260, the front case 300 is fixed to the back case 200, and by operating the fixture 320 to the release position, the engagement with the engaging metal fitting 260 is released, and the front case 300 can be removed from the back case 200.

The telescopic handle 330 is connected to a telescopic rod (not shown), and can be moved in the vertical direction (the arrow U-D direction) by the expansion and contraction of the telescopic rod (the expanded state is not shown). The upper handle 340 and the transverse handle 350 are rotatably (can stand and lie down) mounted on the edges on the back surface side (the side of the back case 200, the side of the arrow B direction).

The rotation axis of the wheel 360 has an axial direction along the left-right direction (the arrow L-R direction) of the case body 310, and the wheel 360 has a size (outer diameter) that protrudes with respect to the front surface and the lower side surface of the case body 310 (see (a) of FIG. 8). The leg member 370 is formed so that the height dimension from the lower side surface of the case body 310 is set larger than the height dimension of the fixture 320 and the fixture 320 does not hit (contact) the floor FL (see (b) of FIG. 8).

Next, the plate 100 will be described with reference to FIG. 3. (a) of FIG. 3 is a front view of the plate 100, and (b) of FIG. 3 is a rear view of the plate 100.

Figure 3:
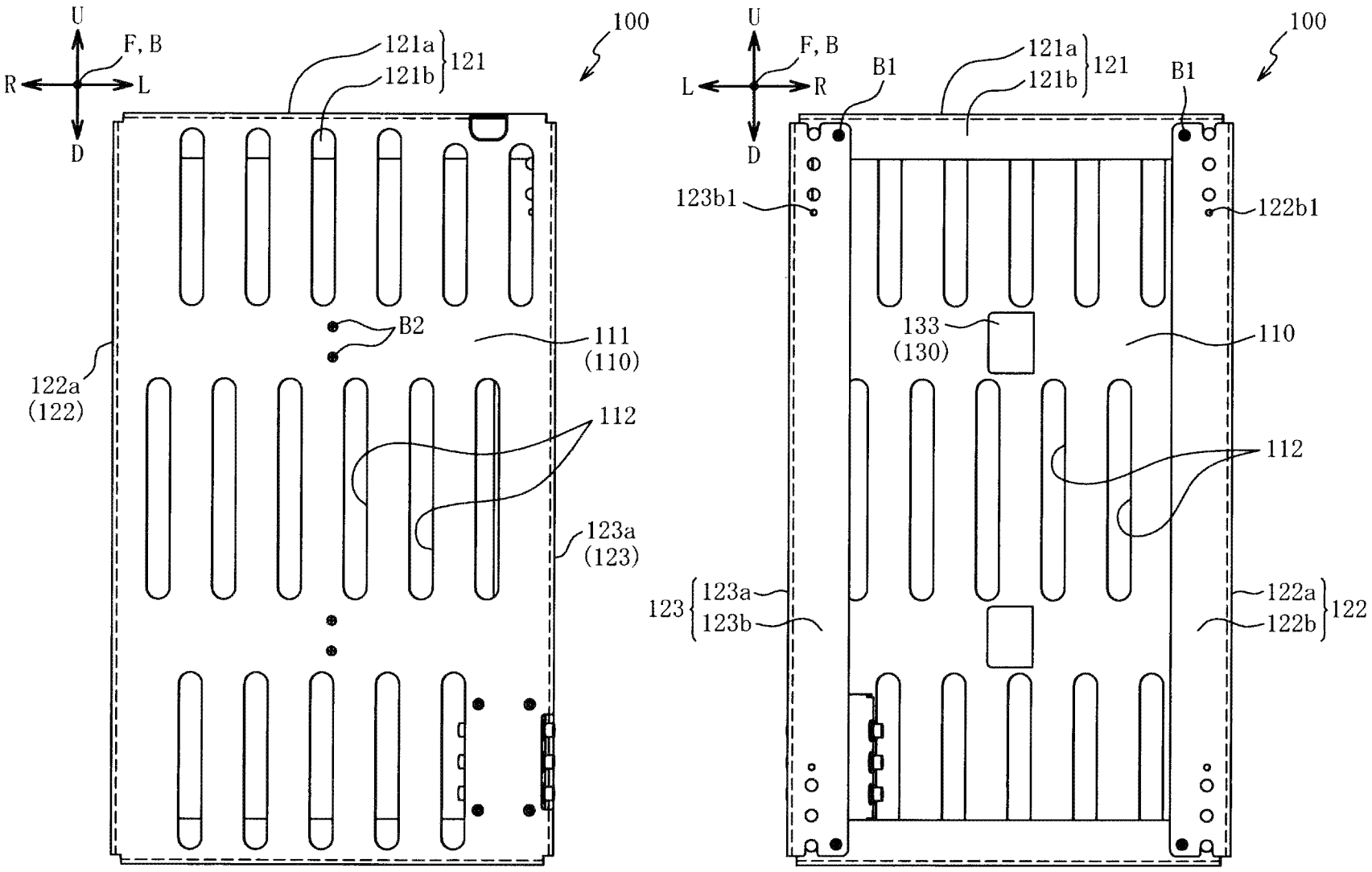

As shown in FIG. 3, the plate 100 includes a main body 110 formed in a rectangular shape when viewed from the front (viewed in the arrow B direction), and side walls 121 to 123 formed along four sides (outer edges) of the main body 110, and is formed by bending a plate made of a metal material. Further, on the plate 100, connecting members 130 are fastened and fixed to a plurality of positions (two in the present embodiment) by fastening screws B2 on the back surface of the main body 110.

In the present embodiment, the plate 100 is made of an aluminum alloy and the connecting member 130 is made of carbon steel. However, the plate 100 and the connecting member 130 may be made of other metal materials (for example, aluminum alloy, stainless steel, carbon steel), respectively.

The main body 110 is a portion in which the mounted surface 111 to which the effector E is mounted is formed on the front surface (the surface on the front side of the paper surface of FIG. 3), and includes a plurality of through holes 112 formed penetrating in the plate thickness direction (from the front surface to the back surface).

The through hole 112 is formed in an elongated hole shape having a size that allows wiring (wiring for connecting the effectors E to each other and wiring for power supply) to pass through, a plurality of through holes 112 are arranged as a set at predetermined intervals in the left-right direction (the arrow L-R direction) in a posture in which the major axis direction is along the vertical direction (the arrow U-D direction), and three sets are formed side by side in the vertical direction (the arrow U-D direction). The shape, number, and formation position of the through holes 112 are arbitrary.

The side wall 121 is a portion formed along each of a pair of short sides of the main body 110, and includes a standing wall portion 121*a* extending from the outer edge of the short side of the main body 110 to the back surface side (the back side of the paper surface of (a) of FIG. 3), and a folded-back portion 121*b* formed by folding back the tip end side of the standing wall portion 121*a* to the inner side (the side facing the back surface of the main body 110).

The side wall 122 is a portion formed along one (the side in the arrow R direction) of a pair of long sides of the main body 110, and the side wall 123 is a portion formed along the other one (the side in the arrow L direction) of the pair of long sides of the main body 110. The side walls 122 and 123 include standing wall portions 122*a* and 123*a* extending from the outer edges of the long sides of the main body 110 to the back surface side (the back side of the paper surface of (a) of FIG. 3), and folded-back portions 122*b* and 123*b* formed by folding back the tip end sides of the standing wall portions 122*a* and 123*a* to the inner side (the side facing the back surface of the main body 110).

The height dimension of the standing wall portion 123*a* (the dimension in the direction perpendicular to the paper surface of (a) of FIG. 3) is set larger than the height dimension of the standing wall portion 122*a*. As a result, as will be described later, in a state where the plate 100 is mounted on the back case 200, the main body 110 (the mounted surface 111) is inclined upward from the side of the side wall 122 to the side of the side wall 123 (see FIG. 6 and FIG. 7).

The folded-back portions 122*b* and 123*b* are respectively folded over on the back surface (the surface on the front side of the paper surface of (b) of FIG. 3) of the folded-back portion 121*b*, and the overlapped portions are fastened and fixed by fastening screws B1. As a result, the folded-back portions 121*b* to 123*b* are connected to each other and support each other, which improves the rigidity of the plate 100 as a whole.

Female screws 122*b*1 and 123*b*1 are respectively formed at two positions (four positions in total) on the folded-back portions 122*b* and 123*b*. As will be described later, the plate 100 is fastened and fixed to the back case 200 by fastening the fastening screws B3 to the female screws 122*b*1 and 123*b*1 (see FIG. 7).

Figure 6:
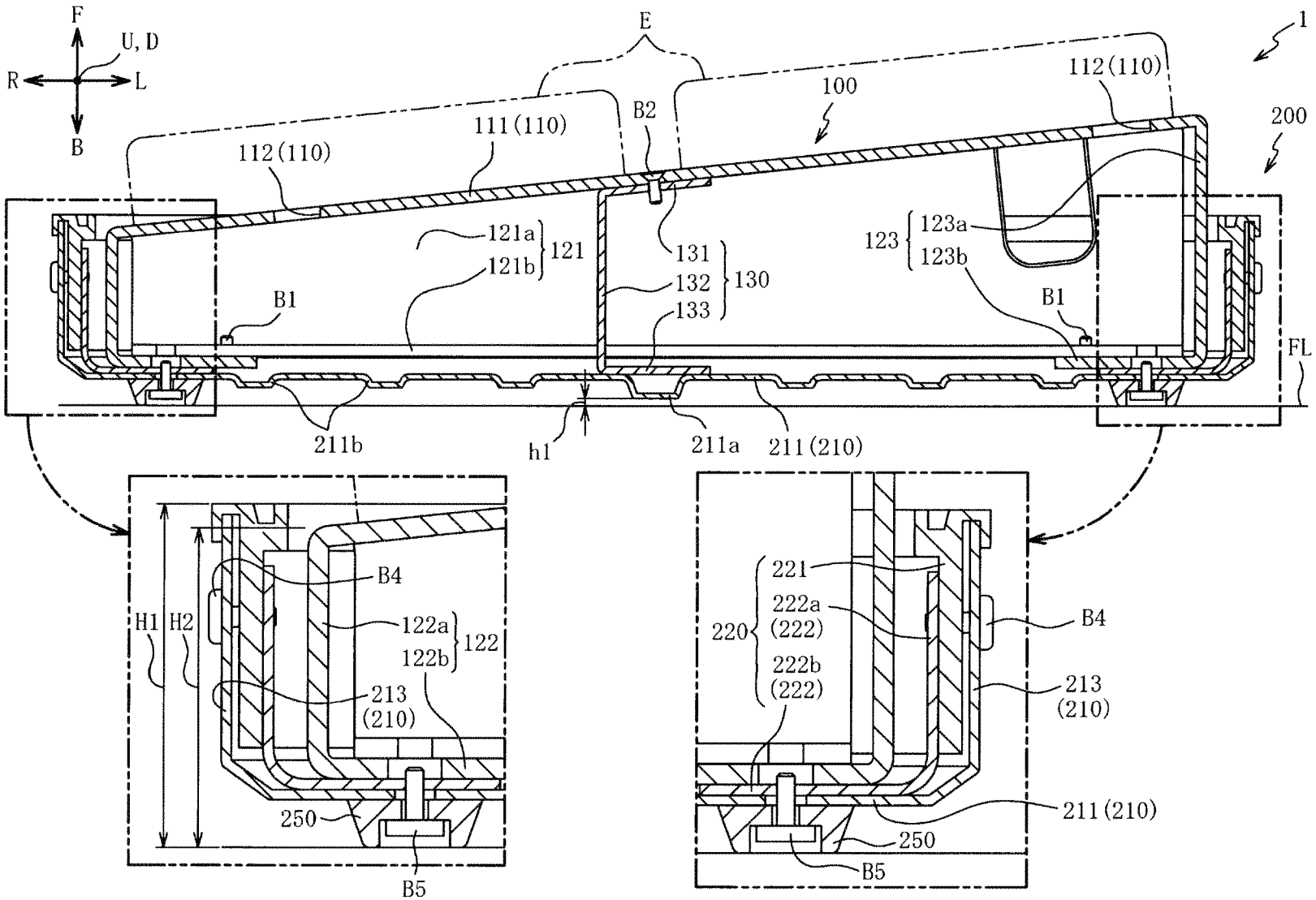
FIG. 6 is a cross-sectional view of the plate and the back case.
Figure 7:
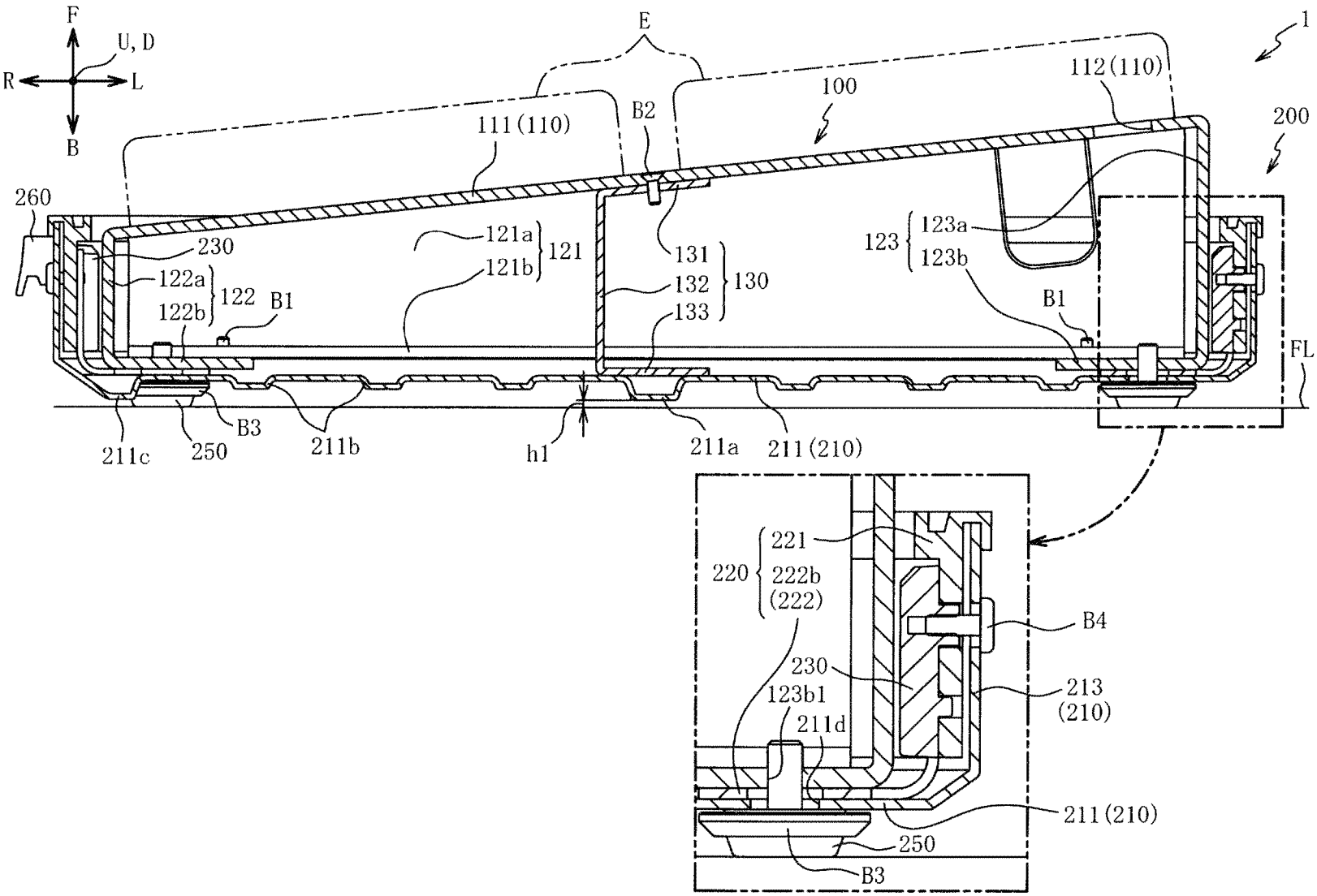
FIG. 7 is a cross-sectional view of the plate and the back case.

The connecting member 130 includes a fastened portion 131 to be fastened and fixed to the back surface of the main body 110 by the fastening screw B2, a standing wall portion 132 extending from the edge of the fastened portion 131 to the back surface side (the back side of the paper surface of (a) of FIG. 3), and a folded-back portion 133 formed by folding back the tip end side of the standing wall portion 132 (see FIG. 6 and FIG. 7). In a state where the plate 100 is mounted on the back case 200, the back surface of the folded-back portion 133 is in contact with the front surface of the back case 200 (the main body 211).

The folded-back portion 133 of the connecting member 130 is on the front surface of the back case 200 (the main body 211), and is in contact with a position corresponding to a first protruding portion 211*a* described later (an overlapping position when viewed from the back (viewed in the arrow F direction)). In this case, the width dimension of the folded-back portion 133 (the dimension in the arrow L-R direction) is set larger than the width dimension (the dimension in the arrow L-R direction) of the first protruding portion 211*a* of the back case 200 (the main body 211) (see FIG. 6 and FIG. 7). That is, the folded-back portion 133 is in contact with the front surface of the main body 211 in a state of straddling the first protruding portion 211*a* in the width direction. As a result, the main body 211 can be easily prevented from being deformed by an external force when the effector E is operated (when stepped on).

The mounting position of the connecting member 130 is a position determined by dividing the direction along the long side of the main body 110 (the arrow U-D direction) into three equal parts, and is set to a position substantially at the center in the direction along the short side of the main body 110 (the arrow L-R direction). As a result, the connecting members 130 are respectively located at positions separated from the outer edge of the main body 110 by substantially equal distances. Therefore, the external force generated when the effector E is operated (when stepped on) can be effectively supported by a smaller number of connecting members 130. As a result, bending of the main body 110 (damage of the plate 100) can be prevented while the product cost is reduced.

Figure 4:
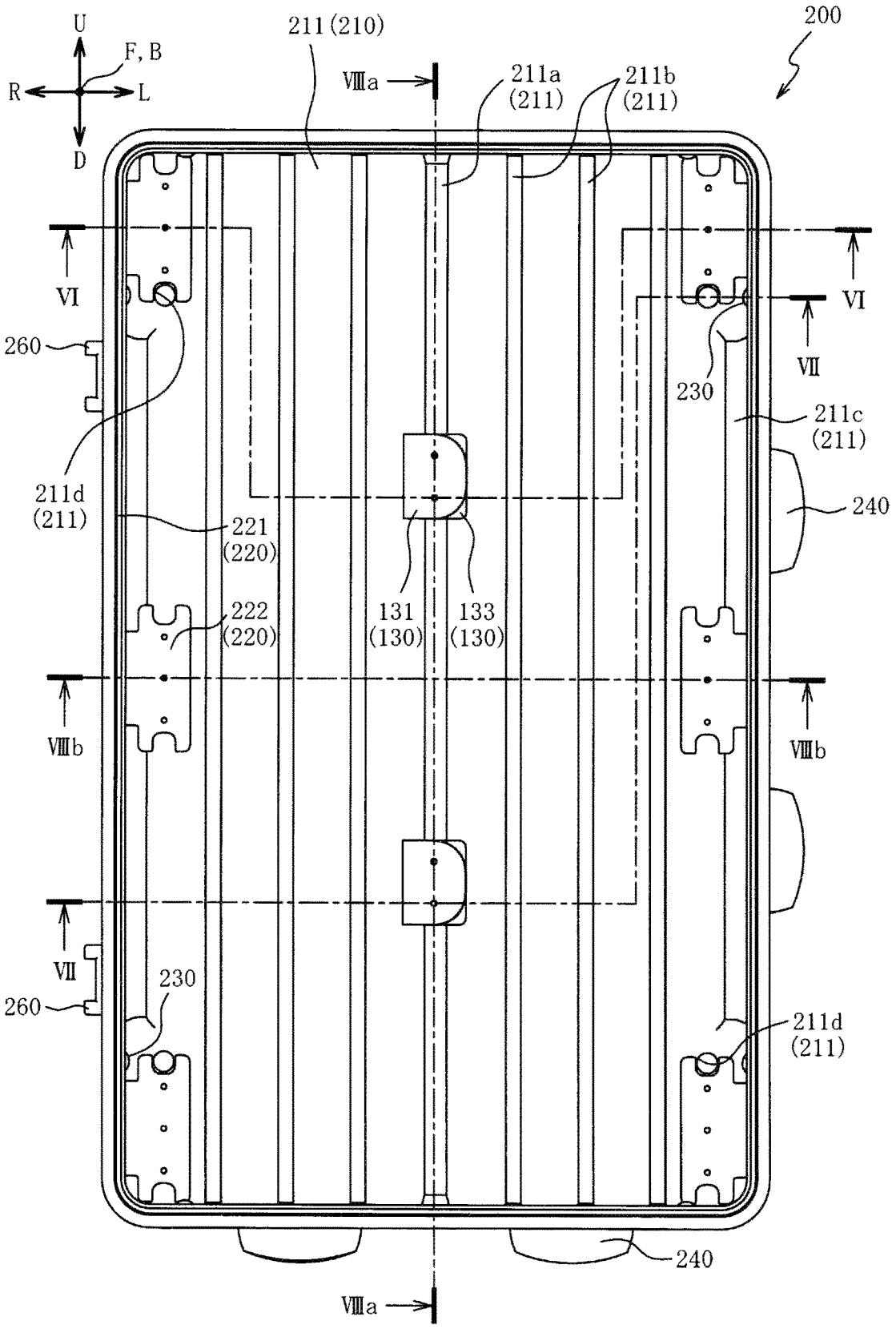
FIG. 4 is a front view of the back case.
Figure 5:
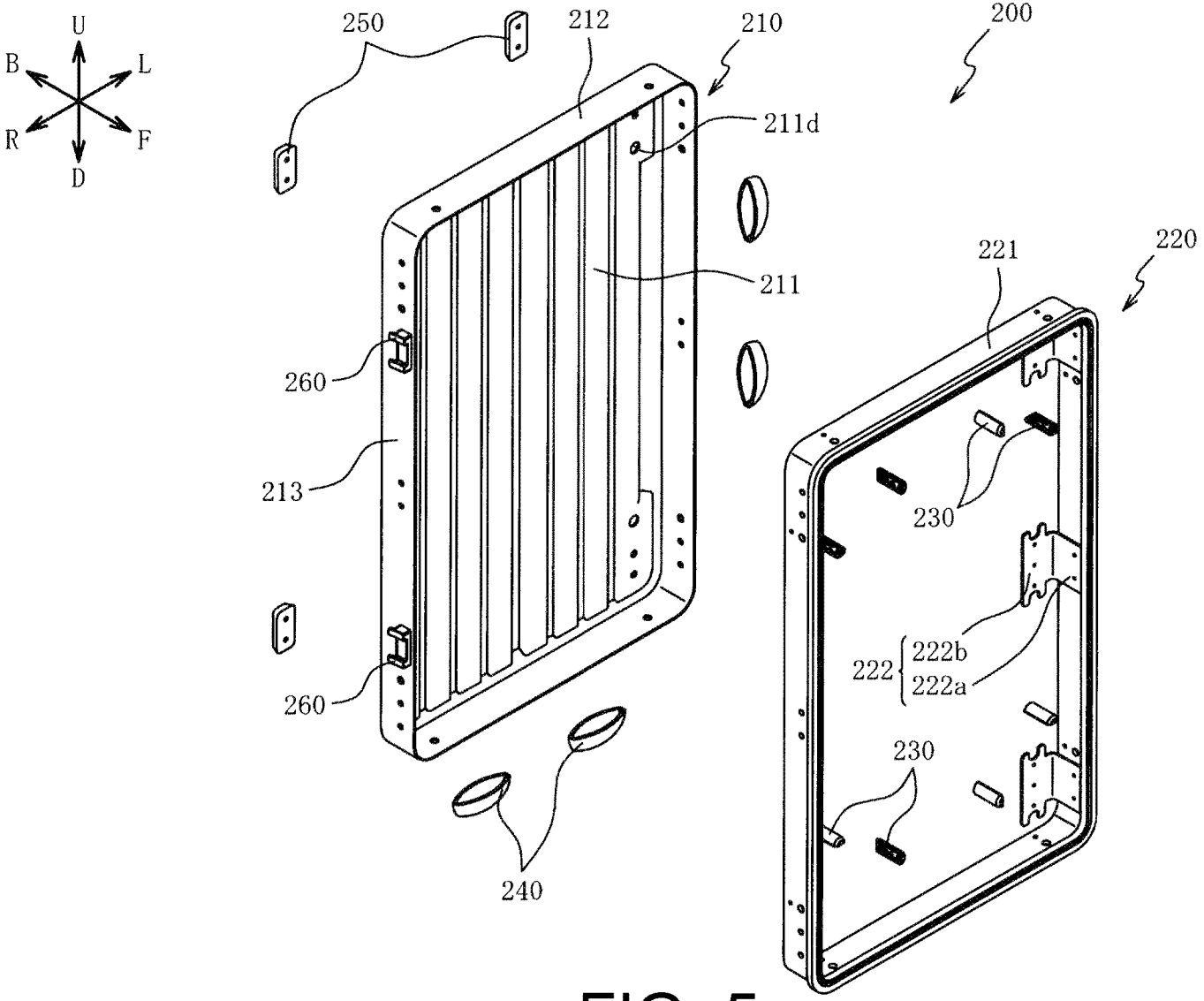
FIG. 5 is an exploded front perspective view of the back case.

Next, the back case 200 will be described with reference to FIG. 4 and FIG. 5. FIG. 4 is a front view of the back case 200, and FIG. 5 is an exploded front perspective view of the back case 200. In FIG. 4, the connecting member 130 is shown at a position corresponding to the state where the back case 200 is mounted on the plate 100.

As shown in FIG. 4 and FIG. 5, the back case 200 includes an exterior member 210 formed in a box shape with the front surface side of the rectangular parallelepiped opened, a frame 220 mounted on the inner surface of the exterior member 210, a plurality of cushioning members 230 mounted on the inner surface of the frame 220, a plurality of leg members 240 and support members 250 mounted on the outer side of the exterior member 210.

The exterior member 210 includes a main body 211 formed in a rectangular shape when viewed from the front (viewed in the arrow B direction), and side walls 212 and 213 formed along four sides (outer edges) of the main body 211, and is formed by injection molding from a resin material. In the present embodiment, the exterior member 210 is made of polycarbonate (PC). However, the exterior member 210 may be made of another resin material (for example, ABS resin) or a metal material (for example, aluminum alloy).

On the main body 211, a first protruding portion 211*a*, a second protruding portion 211*b*, and a third protruding portion 211*c* that protrude from the back surface (see (b) of FIG. 1, FIG. 6, and FIG. 7), and insertion holes 211*d* penetrating in the plate thickness direction (from the front surface to the back surface) are formed.

The first protruding portion 211*a*, the second protruding portion 211*b*, and the third protruding portion 211*c* are formed integrally with the main body 211 (see FIG. 6 and FIG. 7), and are formed to extend linearly along the long side of the main body 211 and arranged at predetermined intervals (substantially equal intervals) in the direction (the arrow L-R direction) along the short side of the main body 211 when viewed from the back (viewed in the arrow F direction) (see (b) of FIG. 1).

The first protruding portion 211*a* is formed at a position where the connecting member 130 (the folded-back portion 133) is in contact with, the second protruding portion 211*b* is formed in a plurality of rows (three rows each on the left and right in the present embodiment) on both the left and right sides (the side in the arrow L direction and the side in the arrow R direction) of the first protruding portion 211*a*, and the third protruding portion 211*c* is formed at a position in contact with the outer edge of each of a pair of long sides of the main body 211. Further, the height dimensions of the first protruding portion 211*a* and the third protruding portion 211*c* protruding from the back surface of the main body 211 are set larger than the second protruding portion 211*b* (see FIG. 6 and FIG. 7).

The insertion hole 211*d* is a hole through which the fastening screw B3 for mounting (fastening and fixing) the plate 100 on the back case 200 is inserted (see FIG. 7), and is formed at four positions corresponding to the female screws 122*b*1 and 123*b*1 of the plate 100 (the side walls 122 and 123).

The frame 220 is a member that reinforces the exterior member 210 and forms a pedestal when the plate 100 is mounted, and includes a frame body 221 formed in a rectangular tubular shape when viewed from the front (viewed in the arrow B direction) and mounted on the inner surfaces of the side walls 212 and 213 of the exterior member 210, and a plurality of (six in the present embodiment) pedestal frames 222 mounted on the inner surface of the frame body 221, each of which is made of a metal material.

In the present embodiment, the frame body 221 is made of an aluminum alloy and the pedestal frame 222 is made of carbon steel. However, the frame body 221 and the pedestal frame 222 may be made of other metal materials (for example, the frame body 221 may be made of carbon steel or stainless steel, and the pedestal frame 222 may be made of an aluminum alloy or stainless steel).

The pedestal frame 222 includes a base portion 222*a* mounted on the inner surface of the long side (the portion along the arrow U-D direction) of the frame body 221, and a pedestal portion 222*b* extending from the base portion 222*a* to the inner side of the frame body 221. In a state where the frame 220 is mounted on the exterior member 210, the pedestal portion 222*b* is located on the front surface of the exterior member 210 (the main body 211). That is, a surface (pedestal) for placing the side walls 122 and 123 (the folded-back portions 122*b* and 123*b*) of the plate 100 is formed by the pedestal portions 222*b*.

The cushioning member 230 is a member made of a resin material, and a plurality of the cushioning members 230 (two on each side in the present embodiment, a total of eight) are respectively arranged on the inner surface of the short side and the inner surface of the long side of the frame body 221. In the present embodiment, the cushioning member 230 is made of ABS resin. However, the cushioning member 230 may be made of another resin material (for example, polycarbonate (PC)) or a rubber material.

The cushioning member 230 protrudes from the inner surface of the frame body 221 with respect to the base portion 222*a* of the pedestal frame 222 (see FIG. 7). As a result, as will be described later, damage of the outer surface of the plate 100 (the side walls 121 to 123) due to hitting on (contact with) the inner surface of the frame body 221 or the pedestal frame 222 (the base portion 222*a*) is prevented.

Female screws (not shown) are formed on the pedestal frame 222 and the cushioning member 230, and the fastening screw B4 inserted from the outer surface of the exterior member 210 (the side walls 212 and 213) is fastened to each female screw of the pedestal frame 222 or the cushioning member 230 (see FIG. 1, FIG. 6, and FIG. 7), by which the frame 220 and the cushioning member 230 are fastened and fixed to the inner surface of the exterior member 210 (the side walls 212 and 213).

The leg member 240 is mounted on the outer surface (each of the left side surface and the lower side surface) of the exterior member 210 (the side walls 212 and 213), and the support member 250 is mounted on the outer surface (the back surface) of the exterior member 210 (the main body 211). The support member 250 is mounted at a position overlapping the pedestal portion 222*b* of the pedestal frame 222 when viewed from the front (viewed in the arrow F-B direction, and is fastened and fixed to the pedestal portion 222*b* of the pedestal frame 222 by the fastening screw B5 (see FIG. 6).

Next, the effector case 1 with the front case 300 removed (that is, the plate 100 and the back case 200 formed to be usable as a pedal board) will be described with reference to FIG. 6 and FIG. 7.

FIG. 6 and FIG. 7 are cross-sectional views of the plate 100 and the back case 200. FIG. 6 corresponds to a cross-sectional view taken along the line VI-VI of FIG. 4, and FIG. 7 corresponds to a cross-sectional view taken along the line VII-VII of FIG. 4. In FIG. 6 and FIG. 7, the effectors E are schematically shown by two-dot chain lines while the wiring connected to the effectors E is omitted. Further, FIG. 6 and FIG. 7 show a state where the effector case 1 is placed on the floor FL. The same applies to FIG. 8.

As shown in FIG. 6 and FIG. 7, according to the effector case 1, the plate 100 and the back case 200 can be used as a pedal board by removing the front case 300.

In this case, the back surface side of the plate 100 is covered by the back case 200, and a space is formed between the plate 100 and the back case 200. Thus, the wiring can pass through the through holes 112 to the back surface side of the main body 110 and be stored in the storage space. As a result, it is possible to prevent the wiring from causing a mess on the mounted surface 111. Therefore, the appearance can be improved, and the wiring can be prevented from becoming an obstacle during performance.

In addition, since the space between the plate 100 and the back case 200 is surrounded by the side walls 212 and 213 of the back case 200, it is possible to prevent the internal wiring from being visually recognized from the outside. In particular, since the side walls 121 to 123 are respectively formed on the four sides of the plate 100, it is possible to prevent the wiring from being visually recognized from the gap between the outer edge of the mounted surface 111 of the plate 100 and the side walls 212 and 213 of the back case 200. Therefore, the appearance can be improved.

Moreover, even in a state where the effector E and the wiring are still mounted, the plate 100 and the back case 200 can be carried with the wiring protected by the back case 200. Therefore, it is possible to prevent an external force from acting on the wiring when the effector case 1 is carried, and thereby it is possible to prevent the wiring (jack) from falling off due to the external force acting on the wiring and to prevent the wiring from being forcibly bent and broken. That is, the effector case 1 can not only be used as a pedal board with the back case 200 mounted, but also be carried as it is used as a pedal board after being used as a pedal board.

On the other hand, even though the wiring is stored in the space between the plate 100 and the back case 200, by removing the fastening screws B3, the back case 200 can be removed from the plate 100 to open the back surface side of the plate 100 (the space between the plate 100 and the back case 200). As a result, for example, work on the wiring such as work of connecting/disconnecting the wiring to/from the effector E and work of checking the wiring before performance (work in the space between the plate 100 and the back case 200) can be easily performed.

Since the back case 200 (main body 211) has a larger outer shape than the plate 100 (main body 110) and the back case 200 covers the entire back surface side of the plate 100, by removing the back case 200 from the plate 100, the back surface side of the plate 100 can be opened to the maximum. Therefore, a large work space for performing the work (work on the wiring) in the space between the plate 100 and the back case 200 can be secured, and workability can be improved.

Here, for example, if the connecting members 130 are fastened and fixed to the exterior member 210 (main body 211) of the back case 200, when the back case 200 is removed from the plate 100, the wiring routed to the back surface side of the plate 100 may be entangled with and pulled by the connecting members 130 fastened and fixed to the back case 200. In contrast thereto, since the connecting members 130 are fastened and fixed to the main body 110 of the plate 100, the wiring can be prevented from being entangled with and pulled by the connecting members 130 when the back case 200 is removed from the plate 100.

In the state where the back surface side (the support members 250) of the back case 200 is placed on the floor FL, the mounted surface 111 of the plate 100 is inclined upward from the side of the side wall 122 to the side of the side wall 123. Therefore, the operating portion of the effector E can be directed toward the performer side corresponding to the upward inclination so the operability when using the plate 100 and the back case 200 as a pedal board can be improved.

In this case, the mounted surface 111 of the plate 100 is located above (the side opposite to the floor FL and the side in the arrow F direction) the side walls (the side walls 212 and 213 and the frame body 221) of the back case 200. As a result, it is possible to prevent the side walls of the back case 200 from becoming an obstacle when operating the effector E.

Here, the height dimension H1 (the dimension in the arrow F-D direction from the floor FL in the state where the back surface side (the support members 250) of the back case 200 is placed on the floor FL, see FIG. 6) of the side walls (the side walls 212 and 213 and the frame body 221) of the back case 200 is set to about 5 cm in the present embodiment. As a result, the effector E mounted on the edge of the mounted surface 111 on the side closest to the performer (the lowermost region in the present embodiment) can be operated with the foot while keeping the heel on the floor FL. Therefore, the strength of the back case 200 and the operability of the effector E can both be achieved. It is better to lower the height dimension H1 from the viewpoint of the operability of the effector E, but from the viewpoint of ensuring both the operability of the effector E (operation with the heel placed on the floor FL) and the strength of the back case 200 and the space (space for storing the wiring) on the back surface side of the plate 100 (the main body 110), the height dimension H1 is preferably set in the range of about 4 cm to about 6 cm.

The height dimension H2 (the dimension in the arrow F-D direction from the floor FL in the state where the back surface side (the support members 250) of the back case 200 is placed on the floor FL, see FIG. 6), on the edge on the side closest to the performer (the lowest region in the present embodiment), of the mounted surface 111 of the plate 100 is set smaller than the height dimension H1 of the side walls of the back case 200 (H2<H1). As a result, a part of the mounted surface 111 of the plate 100 (a part on the side of the side wall 122) is located below the side wall of the back case 200 (the side of the floor FL and the side in the arrow B direction), but even if the effector E is mounted on the edge of the mounted surface 111 on the side closest to the performer, the operating portion of the effector E is located above the side wall of the back case 200, and the height dimension H2 of the mounted surface 111 is set so that the effector E can be operated with the heel placed on the floor FL. In the present embodiment, the height dimension H2 is set to about 4.5 cm.

As described above, the back case 200 includes the exterior member 210 made of a resin material in a box shape with the front surface side of the rectangular parallelepiped opened, and the frame 220 made of a metal material. The plate 100 (the side walls 122 and 123) is mounted on the frame 220 (the pedestal portion 222*b* of the pedestal frame 222) of the back case 200. As a result, it is possible to prevent the exterior member 210 from being damaged by an external force when the effector E is operated (when stepped on).

In particular, as described above, the support member 250 is mounted on the back surface side of the pedestal portion 222*b* of the pedestal frame 222 (at an overlapping position when viewed from the front (viewed in the arrow F-B direction), and the exterior member 210 (the main body 211) is sandwiched between the pedestal portion 222*b* and the support member 250. Therefore, it is possible to easily prevent the exterior member 210 from being bent and damaged by an external force when the effector E is operated (when stepped on).

In this way, the back case 200 forms the entire outer shape with the exterior member 210 made of a resin material and can play a role of covering the back surface side of the plate 100 and improve the appearance (texture), and forms only the main part with the frame 220 made of a metal material to ensure the strength (durability). Thus, as compared with a case where the back case 200 is made of only a resin material or a metal material, it is possible to reduce the product cost, reduce the weight, and secure the strength (durability) at the same time.

In the back case 200, the frame body 221 made of a metal material and having a tubular shape continuous in the circumferential direction is mounted on the inner surfaces of the side walls 212 and 213 of the exterior member 210, by which the rigidity of the exterior member 210 made of a resin material is effectively increased. On the other hand, if the frame body 221 made of a metal material is mounted on the inner surfaces of the side walls 212 and 213 in this way, when the plate 100 is mounted on or detached from the back case 200, the outer surface of the plate 100 (the side walls 121 to 123) may hit (contact) the inner surface of the frame body 221 and damage both.

In contrast thereto, as described above, the cushioning members 230 are mounted on the inner surface of the frame body 221 so the outer surface of the plate 100 (the side walls 121 to 123) is prevented from hitting (contacting) the inner surface of the frame body 221 or the pedestal frame 222 (the base portion 222*a*), and damage can be prevented.

Here, the plate 100 may be mounted on the back case 200, for example, by fastening the fastening screws B3 to the standing wall portions 122*a* and 123*a* of the side walls 122 and 123 of the plate 100, but in this case, the fastening screws B3 are easily damaged by a shearing force caused by an external force when the effector E is operated (when stepped on). In contrast thereto, the folded-back portions 122*b* and 123*b* are formed on the side walls 122 and 123 of the plate 100, and the folded-back portions 122*b* and 123*b* are fastened and fixed to the front surface side of the back case 200 (the pedestal portion 222*b* of the pedestal frame 222) by the fastening screws B3. As a result, it is possible to prevent the fastening screws B3 from receiving a shearing force and being damaged.

The connecting member 130 is mounted, as described above, between the back surface of the plate 100 (the main body 110) and the front surface of the back case 200 (the main body 211). As a result, the external force received by the plate 100 (the main body 110) when the effector E is operated (when stepped on) is supported by the connecting member 130, and deformation of the plate 100 (particularly, bending of the main body 110) can be prevented. As a result, damage to the plate 100 can be prevented.

The first protruding portion 211*a*, the second protruding portion 211*b*, and the third protruding portion 211*c* are formed on the main body 211 of the back case 200 to increase the rigidity. As a result, it is possible to prevent the main body 211 from being damaged in the case of supporting an external force via the connecting member 130 when the effector E is operated (when stepped on). In particular, as described above, the portion of the main body 211 that comes into contact with the connecting member 130 (the folded-back portion 133) is formed with the first protruding portion 211*a* having an increased protruding height (that is, the rigidity is increased) so damage to the main body 211 can be easily prevented.

In this case, the protruding height of the support member 250 from the back surface of the main body 211 (the dimension in the arrow F-B direction) is set larger than the protruding height of the first protruding portion 211*a* from the back surface of the main body 211. Therefore, in the state where the back surface side (the support member 250) of the back case 200 is placed on the floor FL, a gap (interval) is formed between the floor FL and the first protruding portion 211*a* by the dimension h1.

As a result, when the effector E is operated (stepped on) with a normal force (a force smaller than a predetermined value), the effector E is supported with a gap formed between the floor FL and the first protruding portion 211*a*, and when the effector E is operated (stepped on) with a relatively large force that exceeds the predetermined value, the first protruding portion 211*a* hits the floor FL, and the floor FL can also be used to support the external force. That is, since the first protruding portion 211*a* can function as an auxiliary role, it is possible to prevent the outer surface of the exterior member 210 (the first protruding portion 211*a*) from being soiled or damaged.

The protruding height (the dimension in the arrow F-B direction) of the second protruding portion 211*b* from the back surface of the main body 211 is set so that the second protruding portion 211*b* does not hit the floor FL even if the first protruding portion 211*a* hits the floor FL. As a result, it is possible to minimize the soiled or damaged region on the outer surface of the exterior member 210 (the main body 211).

Next, the effector case 1 (a case that can be carried with the effector E stored) with the front case 300 mounted on the back case 200 will be described with reference to FIG. 8.

(a) and (b) of FIG. 8 are schematic cross-sectional views of the effector case 1. (a) of FIG. 8 corresponds to a cross-sectional view taken along the line VIIIa-VIIIa of FIG. 4, and (b) of FIG. 8 corresponds to a cross-sectional view taken along the line VIIIb-VIIIb of FIG. 4.

As shown in (a) and (b) of FIG. 8, according to the effector case 1, the pedal board (the plate 100 and the back case 200) can be set to a portable state simply by mounting the front case 300. Further, at the destination, the plate 100 and the back case 200 can be used as the pedal board simply by removing the front case 300 (see FIG. 6 and FIG. 7).

That is, for the conventional pedal board, it is necessary to carry the pedal board in a case or bag, and in this case, it is necessary to perform work of opening the case or bag, work of storing the pedal board in the case or bag, and work of closing the case or bag. Furthermore, at the destination, it is necessary to perform work of opening the case or bag and taking out the pedal board from the case or bag. In contrast thereto, according to the effector case 1, it is not necessary to perform the above work. Therefore, the user can be troubled less.

Further, in the state where the front case 300 is mounted, the front surface side (the mounted surface 111) of the plate 100 is also covered by the front case 300, and the effector E and the wiring are not exposed. That is, the effector E and the wiring mounted on the mounted surface 111 can be protected by the front case 300. Therefore, it is possible to prevent the effector E from falling off or misaligning, to prevent the set value of the operator (setting knob) from changing, and to prevent the wiring (jack) from falling off or disconnecting when carrying the effector case 1.

As shown in (a) of FIG. 8, the effector case 1 is provided with the telescopic handle 330, the upper handle 340, and the wheels 360. Thus, by holding and pulling the telescopic handle 330 or the upper handle 340, the wheels 360 can be rotated to easily carry the effector case 1. Further, as shown in (b) of FIG. 8, the transverse handle 350 is mounted on the right side surface (the surface on the side in the arrow R direction. Thus, the effector case 1 can also be lifted and carried with the transverse handle 350.

In this case, since the telescopic handle 330, the upper handle 340, the transverse handle 350, and the wheels 360 are mounted on the front case 300, these can be removed from the back case 200 together with the front case 300. Therefore, when the plate 100 and the back case 200 are used as a pedal board, it is possible to prevent the handles 330 to 350 and the wheels 360 from interfering with the performance and impairing the appearance.

As shown in (a) of FIG. 8, the wheels 360 are mounted on the ridge portion between the front surface (the surface in the arrow F direction) and the lower side surface (the surface in the arrow D direction) of the front case 300. Thus, when the wheels 360 are rotated on the floor FL, the leg members 240 are lifted from the floor FL, and the mounted surface 111 of the plate 100 can be in an inclined posture facing downward (the side in the arrow D direction).

Thus, when the effector E is mounted on the mounted surface 111 using a hook-and-loop fastener, the effector E can be in a hanging posture with respect to the mounted surface 111 (a state where a gap is formed between the effector E and the mounted surface 111). As a result, the contact between the effector E and the mounted surface 111 can be prevented to prevent generation of abnormal noise and damage to the effector E and the mounted surface 111 when the effector case 1 is carried.

The hook-and-loop fastener has a hook-shaped engaging portion (male portion) formed on a base material mounted on one of the effector E and the mounted surface 111, and a loop-shaped engaged portion (female portion) formed on a base material mounted on the other of the effector E and the mounted surface 111. The engaging portion and the engaged portion can be engaged with each other.

In the effector case 1, the height dimension by which the wheels 360 protrude from the lower side surface (the lower side surface of the case body 310 (see FIG. 1 and FIG. 2)) is set smaller than the height dimension by which the leg members 240 protrude from the lower side surface (the lower side surface of the exterior member 210 (see FIG. 4 and FIG. 5)). That is, when the floor FL is a plane parallel to the arrow F-B and the arrow L-R, a gap (interval) is formed between the wheels 360 and the floor FL by the dimension h2.

Here, the effector case 1 is positioned so that the mounted surface 111 of the plate 100 is biased toward the back surface (leg members 240) side of the back case 200 with respect to the front surface (wheels 360) side of the front case 300. Therefore, if the effector E is mounted on the plate 100 (the mounted surface 111), the center of gravity of the entire effector case 1 tends to be eccentric to the side of the back case 200 due to the weight of the effector E.

In contrast thereto, according to the effector case 1, in the state where the leg members 240 and the wheels 360 are placed on the floor FL, the front surface of the front case 300 is directed downward (the side in the arrow D direction) due to the above-mentioned dimension h2, and the back surface of the back case 200 is in a posture inclined upward (the side in the arrow U direction). As a result, the eccentricity of the center of gravity can be offset to stabilize the self-standing posture of the effector case 1.

As shown in (b) of FIG. 8, the transverse handle 350 is mounted on the edge on the back surface side (the side of the back case 200 and the side in the arrow B direction) on the right side of the front case 300 (the case body 310 (see FIG. 1 and FIG. 2)). Thus, the transverse handle 350 is located on the upper side of the mounted surface 111 of the plate 100, that is, at a position close to the center of gravity of the entire effector case 1 (or directly above the center of gravity). Therefore, when the effector case 1 is lifted and carried with the transverse handle 350, it is possible to prevent the effector case 1 from inclining.

Even in the state of (b) of FIG. 8, the center of gravity of the entire effector case 1 tends to be eccentric to the side of the back case 200 due to the weight of the effector E. Thus, the height dimension by which the leg member 370 protrudes from the left side surface of the effector case 1 (the surface on the side in the arrow L direction and the left side surface of the case body 310 (see FIG. 1 and FIG. 2)) may be set smaller than the height dimension by which the leg member 240 protrudes from the left side surface of the effector case 1 (the surface on the side in the arrow L direction and the left side surface of the exterior member 210 (see FIG. 4 and FIG. 5)). Thus, the self-standing posture of the effector case 1 can be inclined and stabilized as in the case described above (see (a) of FIG. 8).

Although the disclosure has been described based on the above embodiments, the disclosure is not limited to the above embodiments, and it can be easily inferred that various improvements and modifications can be made without departing from the spirit of the disclosure.

The above embodiment illustrates a configuration that the plate 100 is removed from the back case 200 when work (work on the wiring) in the space between the plate 100 and the back case 200 is performed. However, the disclosure is not necessarily limited thereto. Work (work on the wiring) in the space between the plate 100 and the back case 200 may be performed while the plate 100 is mounted on the back case 200. An example of this configuration will be described with reference to FIG. 9 and FIG. 10 as a modification. The same parts as those in the above embodiment are denoted by the same reference numerals, and the description thereof will be omitted.

(a) and (b) of FIG. 9 are cross-sectional views of an effector case 2001 according to the first modification, and correspond to the cross-sectional view taken along the line VII-VII of FIG. 4. Further, FIG. 9 shows a state where the front case 300 is removed. The same applies to FIG. 10.

As shown in (a) and (b) of FIG. 9, the effector case 2001 includes a pair of rotation shafts S1 that rotatably support the plate 100 on the back case 200. The rotation shafts S1 have an axial direction along the vertical direction (the arrow U-D direction) of the plate 100 and the back case 200, and rotatably support each of the portions of the pair of side walls 121 (the standing wall portion 121*a*) of the plate 100, which are on the side of the side wall 122 (the standing wall portion 122*a*) and the side of the main body 110, on the frame body 221 of the back case 200.

Therefore, by removing the fastening screws B3, the plate 100 can be rotated with respect to the back case 200 with the rotation shafts S1 as the center of rotation. That is, in the state where the back surface side (the support member 250) of the back case 200 is placed on the floor FL, the plate 100 can be erected (see (b) of FIG. 10) to open the back surface side (the side opposite to the mounted surface 111) of the plate 100. As a result, work (work on the wiring) in the space between the plate 100 and the back case 200 can be easily performed.

In the effector case 2001, among a plurality of (4) fastening screws B3 that fasten and fix the plate 100 to the back case 200, a plurality of (2) fastening screws B3 on the side close to the rotation shafts S1 (the side in the arrow R direction) may be omitted. In this case, the strength of mounting the plate 100 on the back case 200 can be secured by the shaft support of the rotation shafts S1 while the workability of the work of opening the back surface side of the plate 100 can be improved corresponding to the reduction in the number of fastening screws B3.

(a) and (b) of FIG. 10 are cross-sectional views of an effector case 3001 according to the second modification, and correspond to the cross-sectional view taken along the line VI-VI of FIG. 4.

As shown in (a) and (b) of FIG. 10, the effector case 3001 is formed so that a part (hereinafter referred to as "separation portion 3211") of the main body 211 of the exterior member 210 can be separated. A female screw 3222*b*1 is formed on each of a plurality of (6) pedestal frames 222 (pedestal portions 222*b*), and the separation portion 3211 is formed in a substantially rectangular shape having an outer shape that overlaps the female screws 3222*b*1 of the pedestal portions 222*b* when viewed from the back (viewed in the arrow F direction), and the outer edge side of the separation portion 3211 is fastened and fixed to the female screws 3222*b*1 of the pedestal portions 222*b* by the fastening screws B6.

Therefore, by removing the fastening screws B6, the separation portion 3211 can be removed to open the region covered by the separation portion 3211 on the back surface side of the plate 100 (the surface opposite to the mounted surface 111) (see (b) of FIG. 10). As a result, work (work on the wiring) in the space between the plate 100 and the back case 200 can be easily performed.

In particular, according to the effector case 3001, work (work on the wiring) in the space between the plate 100 and the back case 200 can be performed even with the front case 300 mounted on the back case 200.

In the effector case 3001, one side of the separation portion 3211 may be connected to the pedestal portions 222*b* of the pedestal frames 222 via hinges, and the separation portion 3211 may be opened and closed with the shafts of the hinges as the rotation shafts.

The above embodiment illustrates a case where an effector (effect device) is mounted, but the disclosure is not necessarily limited thereto. The configuration may be made to mount other devices besides an effector.

In the above embodiment, although the detailed description is omitted, the case body 310 of the front case 300 has substantially the same configuration as the back case 200 except that the depth dimension (the dimension in the arrow F-B direction) is different (increased). That is, the case body 310 of the front case 300 includes an exterior member (corresponding to the exterior member 210 of the back case 200) made of a resin material in a box shape with the back surface side of the rectangular parallelepiped opened, and a frame (corresponding to the frame body 221 of the back case 200) mounted on the inner surface of the exterior member and made of a metal material.

The above embodiment illustrates a case where the front case 300 is mounted on the back case 200, but the disclosure is not necessarily limited thereto. The front case 300 may be mounted on the plate 100.

The above embodiment illustrates a case where the first protruding portion 211*a* and the connecting member 130 (the first protruding portion 211*a*) overlap each other when viewed from the back (viewed in the arrow F direction), but the disclosure is not necessarily limited thereto. The first protruding portion 211*a* and the connecting member 130 (the first protruding portion 211*a*) may not overlap each other when viewed from the back (viewed in the arrow F direction).

The above embodiment illustrates a case where the first protruding portion 211*a*, the second protruding portion 211*b*, and the third protruding portion 211*c* are integrally formed with the exterior member 210 (the main body 211), but the disclosure is not necessarily limited thereto. At least a part of the first protruding portion 211*a*, the second protruding portion 211*b*, and the third protruding portion 211*c* may be formed from separate members, and fastened and fixed to the main body 211 by fastening screws. In particular, the first protruding portion 211*a* may be damaged or soiled as it hits the floor FL. Therefore, it is particularly effective to form the first protruding portion 211*a* as a separate member so as to be replaced.

In the above embodiment, rivets may be used instead of the fastening screws B1, B2, B4, and B5.

The above embodiment illustrates a case where a gap (interval) is formed by the dimension h2 between the wheels 360 and the floor FL (see (a) of FIG. 8), but the disclosure is not necessarily limited thereto. The sizes of the leg members 240 and the wheels 360 may be set so that a gap (interval) is not formed between the wheels 360 and the floor FL.

The above embodiment illustrates a case where a part of the mounted surface 111 of the plate 100 (a part on the side of the side wall 122) is located below (the side of the floor FL and the side in the arrow B direction) the side wall of the back case 200, but the disclosure is not necessarily limited thereto. The entire mounted surface 111 of the plate 100 may be located above the side wall of the back case 200.

That is, the height dimension H2, on the edge on the side closest to the performer, of the mounted surface 111 of the plate 100 may be set larger than the height dimension H1 of the side walls (the side walls 212 and 213 and the frame body 221) of the back case 200 (H1<H2, see FIG. 6). In this case, the height dimension H2 is preferably set to about 5 cm. This is because the effector E can be operated with the heel placed. It is better to lower the height dimension H2 from the viewpoint of the operability of the effector E, but from the viewpoint of ensuring both the operability of the effector E (operation with the heel placed on the floor FL) and the space (space for storing the wiring) on the back surface side of the plate 100 (the main body 110), the height dimension H2 is preferably set in the range of about 4 cm to about 6 cm.

The above embodiment illustrates a case where the mounted surface 111 of the plate 100 is inclined upward from the side of the side wall 122 to the side of the side wall 123 in the state where the back surface side (the support member 250) of the back case 200 is placed on the floor FL, but the disclosure is not necessarily limited thereto. The mounted surface 111 of the plate 100 may be parallel to the floor FL.

The above embodiment illustrates a case where the leg members 240 and 370 and the wheels 360 are included, but the disclosure is not necessarily limited thereto. The leg members 240 and 370 and the wheels 360 may be omitted.

Further, the wheels 360 may be omitted so that the leg members 240 and the lower side surface of the front case 300 (the case body 310) are in contact with the floor FL. In this case, the self-standing posture of the effector case 1 can be stabilized as in the case of the above embodiment (see (a) of FIG. 8).

Further, instead of the wheels 360, the leg members 370 may be mounted on the lower side surface (the surface on the side in the arrow D direction) of the front case 300 (the case body 310). In this case, the height dimension by which the leg members 370 protrude from the lower side surface of the front case 300 is preferably set smaller than the height dimension by which the leg members 240 protrude from the lower side surface of the back case 200. As a result, the self-standing posture of the effector case 1 can be stabilized as in the case of the above embodiment (see (a) of FIG. 8).

The above embodiment illustrates a case where the cushioning members 230 are mounted on the inner surface of the frame body 221, but the disclosure is not necessarily limited thereto. The cushioning members 230 may be mounted on the outer surface of the side walls 121 to 123 of the plate 100. With this configuration, the outer surface of the plate 100 (the side walls 121 to 123) can still be prevented from contacting the inner surface of the frame body 221 or the pedestal frame 222 (the base portion 222*a*) and being damaged.

What is claimed is:

1. An effector mounting plate, comprising:

a mounting member which is formed with a through hole penetrating between a mounting surface, on which an effector is mounted, and a back surface opposite to the mounting surface;

a back surface side member which covers a back surface side of the mounting member and is mounted on the mounting member in a state of forming a space with the back surface of the mounting member;

a first means comprising a pair of rotation shafts for enabling work in the space; and a connecting member, wherein the back surface side member comprises an exterior member made of a resin material and formed in a box shape with a mounting member side opened, and a frame made of a metal material and fixed to the exterior member, and the mounting member is mounted on the frame of the back surface side member, the mounting member comprises a mounted main body on which the mounting surface is formed, and a mounted side wall formed along an outer edge of the mounted main body, wherein the mounted side wall is mounted on the frame of the back surface side member, and the connecting member connects between a front surface of the back surface side member and a back surface of the mounted main body.

2. The effector mounting plate according to claim 1, wherein the first means further comprises at least one of a separation portion, a female screw and a fastening screw which enables the back surface side member to be removed from the mounting member.

3. The effector mounting plate according to claim 2, wherein the back surface side member is formed in a box shape with a mounting member side opened, and in a state where a back surface side of the back surface side member, which is opposite to the mounting member, is placed on a floor, the mounting surface of the mounting member is inclined with respect to the floor, and at least a part of the mounting surface of the mounting member is located above the back surface side member.

4. The effector mounting plate according to claim 1, wherein the back surface side member is formed in a box shape with a mounting member side opened, and in a state where a back surface side of the back surface side member, which is opposite to the mounting member, is placed on a floor, the mounting surface of the mounting member is inclined with respect to the floor, and at least a part of the mounting surface of the mounting member is located above the back surface side member.

5. The effector mounting plate according to claim 1, comprising a cover member which covers a mounting surface side of the mounting member and is mounted on the back surface side member or the mounting member in a state of forming a space with the mounting surface of the mounting member, wherein the cover member is removable from the back surface side member or the mounting member.

6. The effector mounting plate according to claim 5, wherein the cover member comprises wheels which are rotatably mounted on one side of the cover member, and a first handle which is mounted on an other side opposite to one side of the cover member.

7. The effector mounting plate according to claim 5, wherein in a state where the cover member is mounted on the back surface side member or the mounting member, and one side of the back surface side member and one side of the cover member are placed on a floor, an inclined posture is taken with the cover member directed downward and the back surface side member directed upward.

8. The effector mounting plate according to claim 6, wherein in a state where the cover member is mounted on the back surface side member or the mounting member, and one side of the back surface side member and one side of the cover member are placed on a floor, an inclined posture is taken with the cover member directed downward and the back surface side member directed upward.

9. The effector mounting plate according to claim 7, wherein the cover member comprises wheels which are rotatably mounted on one side of the cover member, the back surface side member comprises legs which are mounted on one side of the back surface side member, and in a state where the cover member is mounted on the back surface side member or the mounting member, and the legs of the back surface side member and the wheels of the cover member are placed on a floor, an inclined posture is taken with the cover member directed downward and the back surface side member directed upward.

10. The effector mounting plate according to claim 2, comprising a cover member which covers a mounting surface side of the mounting member and is mounted on the back surface side member or the mounting member in a state of forming a space with the mounting surface of the mounting member, wherein the cover member is removable from the back surface side member or the mounting member.

11. The effector mounting plate according to claim 3, comprising a cover member which covers a mounting surface side of the mounting member and is mounted on the back surface side member or the mounting member in a state of forming a space with the mounting surface of the mounting member, wherein the cover member is removable from the back surface side member or the mounting member.

12. The effector mounting plate according to claim 1, wherein the back surface side member comprises a protruding portion formed to protrude from a back surface of the back surface side member, and the protruding portion is formed at a position corresponding to the connecting member.

13. The effector mounting plate according to claim 12, wherein the back surface side member comprises a support member mounted on the back surface of the back surface side member, the mounted side wall of the mounting member is mounted on the front surface of the back surface side member at a position corresponding to the support member, and a protruding height of the support member from the back surface of the back surface side member is larger than a protruding height of the protruding portion from the back surface of the back surface side member.

14. The effector mounting plate according to claim 1, wherein the mounting member comprises a mounted main body on which the mounting surface is formed, and a mounted side wall formed along an outer edge of the mounted main body, the exterior member comprises an exterior main body having a front surface facing a back surface of the mounted main body, and an exterior side wall formed along an outer edge of the exterior main body, the frame comprises a frame body which is mounted on an inner surface of the exterior side wall and is continuously formed in a circumferential direction, and a cushioning member made of a resin material is mounted on an inner surface of the frame body or an outer surface of the mounted side wall.

15. The effector mounting plate according to claim 1, wherein the mounting member comprises a mounted main body on which the mounting surface is formed, and a mounted side wall formed along an outer edge of the mounted main body, and the mounted side wall is fastened to a front surface side of the back surface side member with a fastening screw.

16. An effector mounting plate, comprising:

a mounting member having a mounting surface on which an effector is mounted;

a back surface side member mounted on the mounting member in a state of covering an opposite side of mounting surface of mounting member;

a cover member mounted on the back surface side member in a state of covering a mounting surface side of the mounting member; and a connecting member, wherein the back surface side member comprises an exterior member made of a resin material and formed in a box shape with a mounting member side opened, and a frame made of a metal material and fixed to the exterior member, and the mounting member is mounted on the frame of the back surface side member, the mounting member comprises a mounted main body on which the mounting surface is formed, and a mounted side wall formed along an outer edge of the mounted main body, wherein the mounted side wall is mounted on the frame of the back surface side member, and the connecting member connects between a front surface of the back surface side member and a back surface of the mounted main body.

17. The effector mounting plate according to claim 16, wherein the cover member comprises wheels which are rotatably mounted on one side of the cover member, and a first handle which is mounted on an other side opposite to one side of the cover member.

18. An effector case, comprising:

a mounting member which is formed with a through hole penetrating between a mounting surface, on which an effector is mounted, and a back surface opposite to the mounting surface;

a back surface side member which covers an entire back surface side of mounting member and is detachably mounted on the mounting member in a state of forming a space with the back surface of the mounting member;

a cover member which is mounted to engage the back surface side member in a state of covering entirety of the mounting surface on a mounting surface side of the mounting member;

wheels which are rotatably mounted on one side of the back surface side member or the cover member;

a handle which is mounted on an other side opposite to the one side of the back surface side member or the cover member; and a connecting member, wherein the back surface side member comprises an exterior member made of a resin material and formed in a box shape with a mounting member side opened, and a frame made of a metal material and fixed to the exterior member, and the mounting member is mounted on the frame of the back surface side member, the mounting member comprises a mounted main body on which the mounting surface is formed, and a mounted side wall formed along an outer edge of the mounted main body, wherein the mounted side wall is mounted on the frame of the back surface side member, and the connecting member connects between a front surface of the back surface side member and a back surface of the mounted main body.

* * * * *